US007799443B2

(12) United States Patent
Mikus et al.

(10) Patent No.: US 7,799,443 B2
(45) Date of Patent: Sep. 21, 2010

(54) COATED CERMET CUTTING TOOL AND USE THEREOF

(75) Inventors: Marian Mikus, Skärholmen (SE); Kenneth Westergren, Hägersten (SE); Leif Åkesson, Älvsjö (SE); Per Mårtensson, Nacka (SE)

(73) Assignee: Sandvik Intellectual Property AB, Sandviken (SE)

( * ) Notice: Subject to any disclaimer, the term of this patent is extended or adjusted under 35 U.S.C. 154(b) by 539 days.

(21) Appl. No.: 11/711,856

(22) Filed: Feb. 28, 2007

(65) Prior Publication Data

US 2008/0210064 A1 Sep. 4, 2008

(30) Foreign Application Priority Data

Mar. 3, 2006 (SE) ..... 0600483-2

(51) Int. Cl.
*B32B 9/00* (2006.01)

(52) U.S. Cl. ..... 428/698; 51/307; 51/309; 407/119; 427/419.1; 428/216; 428/325; 428/336; 428/701; 428/702

(58) Field of Classification Search ..... 51/307, 51/309; 428/216, 325, 336, 472, 698, 701, 428/702; 407/119; 427/419.1
See application file for complete search history.

(56) References Cited

U.S. PATENT DOCUMENTS 4,904,445 A * 2/1990 Iyori et al. ..... 75/242
4,984,940 A * 1/1991 Bryant et al. ..... 428/698
5,059,491 A 10/1991 Odani et al.
5,110,543 A 5/1992 Odani et al.
5,348,806 A * 9/1994 Kojo et al. ..... 75/244
6,007,909 A 12/1999 Rolander et al.
6,010,283 A * 1/2000 Henrich et al. ..... 407/119
6,183,846 B1 2/2001 Moriguchi et al.
6,235,382 B1 5/2001 Matsubara
6,333,099 B1 * 12/2001 Strondl et al. ..... 428/216
7,416,778 B2 * 8/2008 Westergren et al. ..... 428/216
7,544,024 B2 * 6/2009 Omori et al. ..... 407/119
7,553,113 B2 * 6/2009 Omori et al. ..... 407/113
2002/0187370 A1 12/2002 Yamagata et al.

FOREIGN PATENT DOCUMENTS

EP 0 368 336 B1 5/1990

(Continued)

*Primary Examiner*—Archene Turner
(74) *Attorney, Agent, or Firm*—Drinker Biddle & Reath LLP

(57) ABSTRACT

A cutting tool insert has a cermet body with a Co and/or Ni binder phase and a coating deposited as monolayer or as multiple and/or alternating layers of carbide, nitride or oxide. The coating has a thickness of 21-50 μm, when the inserts have a flat rake face, without or with simple chipbreakers and a Co binder phase, or has a thickness of 10-50 μm, when the inserts have a rake face land with a width of 100-300 μm with an angle of 10-25° to the rake face and a Co and/or Ni binder phase. The cermet body has more than 50 vol. % Ti-based carbonitride and less than 15 wt % and more than 6 wt % Co and/or Ni binder phase and a hardness of >1650 HV3. The disclosure also relates to the use of the coated cutting tool insert for the machining of cast iron work pieces.

24 Claims, 1 Drawing Sheet

FOREIGN PATENT DOCUMENTS

| | | |
|---|---|---|
| EP | 0 947 594 A2 | 10/1999 |
| EP | 1 548 154 | 6/2005 |
| EP | 1 626 105 | 2/2006 |
| EP | 1 643 012 | 4/2006 |
| JP | 2002-263940 | 9/2002 |
| JP | 2004-181618 | 7/2004 |
| JP | 2005-111586 | 4/2005 |
| JP | 2005-131739 | 5/2005 |
| JP | 2006-026862 | 2/2006 |

* cited by examiner

A

B

C

D

COATED CERMET CUTTING TOOL AND USE THEREOF

FIELD

The present disclosure relates to a coated cermet cutting tool particularly useful for machining of cast iron work pieces such as nodular cast iron (NCI), compact graphite iron (CGI) and grey cast iron (GCI) at high cutting speed.

BACKGROUND

In the discussion of the background that follows, reference is made to certain structures and/or methods. However, the following references should not be construed as an admission that these structures and/or methods constitute prior art. Applicants expressly reserve the right to demonstrate that such structures and/or methods do not qualify as prior art.

Cermets tools are used with good results in finishing operations of steel but, due to their brittleness, cermets tools are not used in high productivity machining operations together with large cutting depths and large feeds requiring increased toughness. In addition, cermets tools are not used in machining of cast irons, especially not in medium to roughing operations.

The various cast iron grades are machined with use of chemical vapor deposition (CVD) coated cemented carbide cutting tool inserts. Grey cast iron is also machined with silicon nitride based ceramic cutting tools. However ceramic tools are expensive because of the high manufacturing cost. It is therefore a desire, if possible, to replace ceramic tools with less expensive tools. The ceramic tools, such as based on silicon nitride, perform well in grey cast iron, however, show limited tool life in nodular cast iron. Thus, conventional coated cemented carbide tools are used in nodular cast iron area.

However, there are demands from various machining industries for tools with higher productivity and longer tool life than that obtained by conventional coated cemented carbide.

Cemented carbide cutting tools coated with various types of hard CVD layers have been commercially available for years. Such tool coatings are generally built up by one Ti(C, N) and one $Al_2O_3$ hard layer where the Ti(C,N) is the innermost layer adjacent to the cemented carbide. The thickness of the individual layers is carefully chosen to suit different cutting applications and work-piece materials, e.g., cast iron and various steel grades. Coated cemented carbide tool inserts may be used for both continuous and interrupted cutting operations of various types of steels and cast irons.

U.S. Pat. No. 6,007,909, discloses coated cutting tools comprising CVD 1-20 μm thick coating on a Ti based carbonitride cermet body, used in steel cutting, such as finishing operations with relatively small cutting depths. The coating should have compressive residual stresses of 100-800 MPa.

U.S. Pat. No. 6,183,846 disclose a coated cutting tool including a hard coating on a surface of a base material of cemented carbide or cermet. The hard coating includes an inner layer on the base material, an intermediate layer on the inner layer and an outer layer on the intermediate layer. The inner layer with a thickness of 0.1 to 5 μm consists of a carbide, a nitride, a carbonitride, a carbooxide, a carboxinitride or a boronitride of Ti. The intermediate layer consists of $Al_2O_3$ with a thickness of 5 to 50 μm or $ZrO_2$ with a thickness of 0.5 to 20 μm. The outer layer with a thickness of 5 to 100 μm consists of a carbide, a nitride, a carbonitride, a carbooxide, a carboxinitride or a boronitride of Ti.

EP 1643012A discloses a method for high speed machining of a metallic work piece at a cutting speed of 800-1500 m/min, a cutting depth of 2-4 mm, and a feed rate of 0.3-0.7 mm/rev with a coated cemented carbide cutting tool. The cutting tool comprises a coating as a monolayer or multiple layers with a total thickness of 25-75 μm and a cemented carbide body with hardness of >1600 HV3, preferably over 1700 HV3. The best results are obtained in machining of grey cast iron.

SUMMARY

It is therefore an object of the present disclosure to provide a cutting tool insert excellent in high efficiency cutting of nodular cast iron (NCI) and compact graphite iron (CGI).

It has now surprisingly been found that a cutting tool insert comprising a thick coating and a cermet body is excellent in high efficiency cutting of various cast irons, such as nodular cast iron (NCI), compact graphite iron (CGI) and grey cast iron (GCI), preferably machining of nodular cast iron (NCI) and compact graphite cast iron (CGI). The coating is deposited using conventional CVD or MT-CVD-techniques known in the art.

An exemplary cutting tool insert comprises a cermet body including a Co and/or Ni binder phase, and a coating deposited as a monolayer or as multiple and/or alternating layers of carbide, nitride or oxide deposited by CVD- and/or MTCVD-methods, wherein said cermet body includes more than 50 vol. % Ti-based carbonitride and less than 15 wt. % but more than 6 wt. % Co and/or Ni binder phase, wherein said cermet body has a hardness, measured as Vickers Hardness at 3 kg load (HV3), of >1650 HV3, and wherein said coating has one of (a) a thickness of 21-50 μm when the inserts have a flat rake face, without or with simple chipbreakers and a Co binder phase, or (b) a thickness of 10-50 μm when the inserts have a rake face land with a width of 100-300 μm with an angle of 10-25° to the rake face and a Co and/or Ni binder phase.

An exemplary method of use and an exemplary method of machining a workpiece are also disclosed.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which:

In FIGS. 2 and 3: A—$Al_2O_3$, B—Ti(C,N)-layer including bonding and transition layers, C—cermet body, D—cermet body

DETAILED DESCRIPTION

Figure 1:
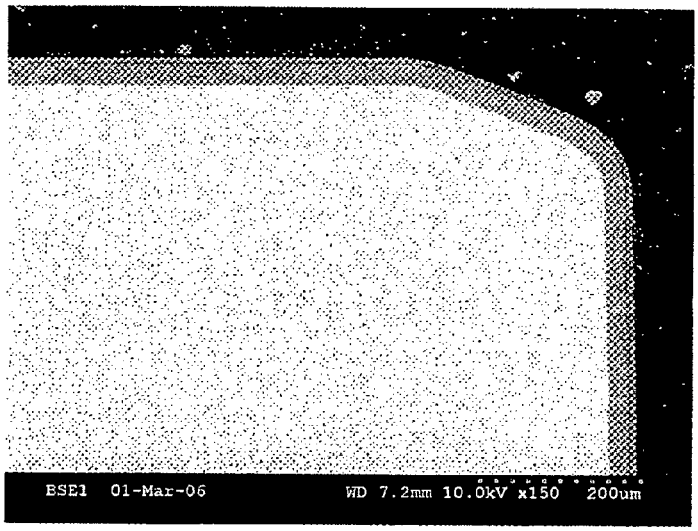
FIG. 1 shows an edge of an insert in cross section provided with a coating.
Figure 2:
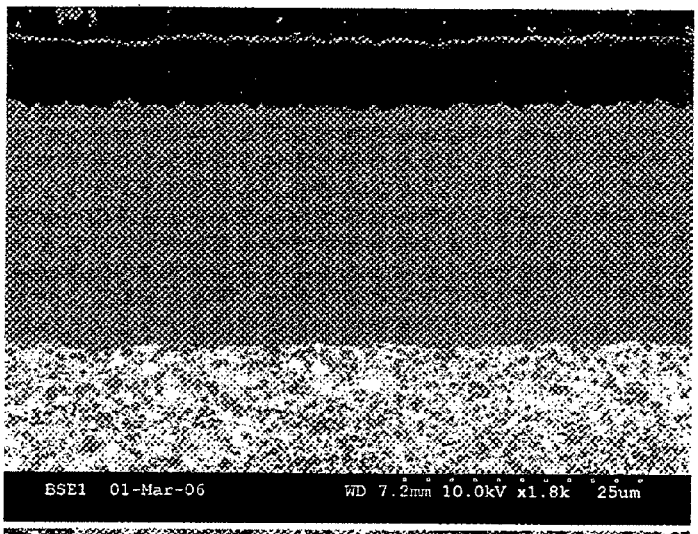
FIG. 2 shows in greater magnification a coating and adjacent cermet body.
Figure 3:
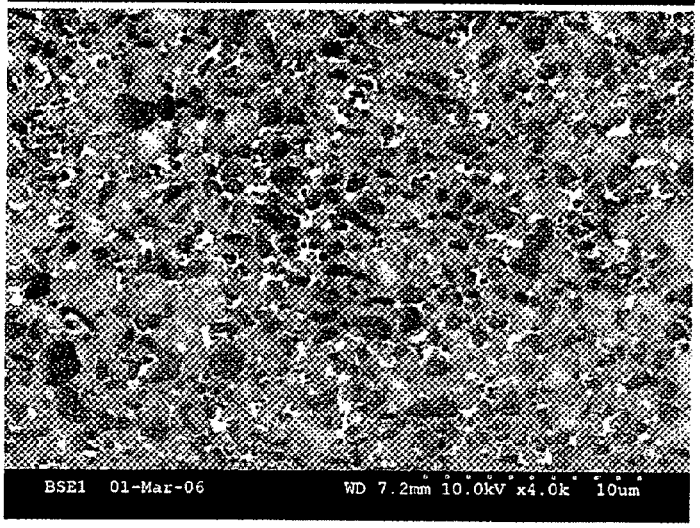
FIG. 3 shows in greater magnification the microstructure of the cermet body.

The present disclosure relates to a cutting tool insert comprising a cermet body comprising Ti-based carbonitride in a Co and/or Ni binder phase and a coating deposited as a monolayer or as multiple and/or alternating layers of carbide, nitride or oxide or solid solutions or mixtures thereof, by CVD- and/or MTCVD-methods. The coating has a thickness of 21-50 μm, preferably 25-50 μm, more preferably 30-50 μm and most preferably 35-50 μm when the inserts have a flat rake face, with or without simple chipbreakers, with a Co-binder phase or a thickness of 10-50 μm, preferably 15-50 μm, more preferably 21-50 μm and most preferably 30-50 μm, when the inserts have a rake face land with a width of 100-300 μm with an angle of 10-25° to the rake face with a Co and/or Ni binder phase.

The cermet insert body consists of a conventional cermet body based, more than 50 vol. %, on a cubic Ti-based carbonitride phase and a binder phase of Co and/or Ni, preferably Co, and at least one of W or Mo. Further elements, which may be present in the cermet body, are those conventionally used in cermet cutting tools such as Ta, Nb, V, Zr, Hf, Cr. The binder phase content is less than 15 wt. %, preferably less than 13 wt. %, most preferably less than 10 wt. %, but more than 6.0 wt. %. The grain size of the Ti-comprising carbonitride phase is 0.5-4 μm, preferably 1-3 μm. The cermet body has a hardness of >1650 HV3, preferably >1750 HV3, most preferably >1775 HV3. Hardness HV3 means Vickers hardness measured at 3 kg weight.

In one embodiment, the coating comprises at least one layer of a carbide, nitride, carbonitride or carboxynitride of one or more of Ti, Zr and Hf or mixtures thereof and at least one layer of alumina, preferably α-alumina in any combination.

In one embodiment, the coating consists of a first layer adjacent to the cermet body with a thickness of more than 6 μm, preferably more than 10 μm and most preferably more than 20 μm but less than 45 μm, preferably less than 30 μm, including at least one of carbide, nitride, carbonitride or carboxynitride of one or more of Ti, Zr and Hf or mixtures thereof, and a second layer of $Al_2O_3$ with a thickness of more than 4 μm, preferably more than 5 μm, most preferably more than 15 μm but less than 44 μm, preferably less than 25 μm, adjacent to the first layer.

In a further preferred embodiment, the coating consists of four layers: a first layer adjacent the cermet body, the first layer including a carbide, nitride, carbonitride or carboxynitride of one or more of Ti, Zr and Hf or mixtures thereof with a thickness of 6-30 μm, preferably 6-15 μm, an α-alumina layer adjacent said first layer with a thickness of 5-30 μm, preferably 5-15 μm, a further layer adjacent the alumina layer, the further layer including a carbide, nitride, carbonitride or carboxynitride of one or more of the metals Ti, Zr and Hf or mixtures or multilayers thereof with a thickness of 3-30 μm, preferably 4-15 μm, and a further α-alumina layer adjacent said further layer with a thickness of 3-40 μm, preferably 4-20 μm. Preferably, the first layer and/or the further layer contain Ti(C,N) with columnar structure.

All thickness values used herein include thin conventional transition and bonding layers or top surface layers such as TiN, Ti(C,N), Ti(C,O), Ti(C,N,O) and Ti(N,O) and/or layers promoting adhesion and/or phase control of a subsequently deposited layer. The thickness of these individual layers is between 0.1 and 2 μm.

In case of the presence of Ni in the cermet body, it is suitable to have a thin interlayer consisting of Ti(C,O) close to the cermet body, less than 2 μm thick, in order to stop Ni diffusion into the coating.

Preferably the top layer is a 4-44 μm, preferably 5-25 μm, thick $Al_2O_3$-layer or a <2 μm thick TiN-layer. This TiN layer can be mechanically removed by known techniques from the rake face. In such case, this outermost layer on the rake face is $Al_2O_3$ and on the clearance faces TiN. Mechanical removal of the TiN-layer is performed by known methods, such as blasting treatment using hard particles.

In some specific embodiments, one or more friction reducing layer(s), such as layers of sulphides of tungsten and/or molybdenum, may be applied as an outermost layer.

The present disclosure also relates to the use of a coated cutting tool insert according to above for the machining of cast iron work pieces, such as nodular cast iron (NCI), compact graphite iron (CGI) and grey cast iron (GCI), at a cutting speed of >300 m/min, preferably 400-1000 m/min and most preferably 600-1000 m/min, at a cutting depth of 2-8 mm and a feed rate of 0.2-0.7 mm/rev. The size of the cutting depth is selected with respect to the size of the cutting inserts. For smaller inserts, the cutting depth is 2-4 mm and for larger ones 2-8 mm.

Example 1

Cermets and cemented carbide substrates A-D with chemical compositions according to Table 1 were produced in the conventional way from powders, which were milled, pressed and sintered with or without subsequent grinding to insert shapes, ISO standard CNMA120416 T02020, CNMA120416-KR and CNMA160616 T02520 and CNMA160616-KR. Furthermore the inserts were subjected to mechanical edge honing.

After that the inserts were cleaned and coated using processes known in the art. Coating compositions and thicknesses appear from Table 2. Two or four layers comprising Ti(C,N) and α-$Al_2O_3$ were deposited. Ti(C,N) was deposited so that a columnar grain structure of the layer was obtained. This was done by using the known MT-CVD process (MT-medium temperature, CVD-chemical vapor deposition) where, besides other gases, acetonitrile, $CH_3CN$, was used as nitrogen and carbon source. The top of alumina layer was coated with a TiN layer.

In the start of the coating process, at the transition zone between the Ti(C,N) and $Al_2O_3$ layers and at the end of the $Al_2O_3$ coating process, conventional processes were also used. These conventional processes resulted in the formation of <2 μm thick transition, bonding or outermost layers of TiN, Ti(C,O) and/or Ti(C,N,O).

The outermost coating was a <2 μm thick TiN layer, which was mechanically removed from the insert's rake face by known $Al_2O_3$ particle blasting technique. Thus, the outermost layer on the rake face is $Al_2O_3$ and on the flank side is TiN. Furthermore the blasting treatment has resulted in smoother surface topography on treated surfaces.

TABLE 1

Chemical composition of the substrates grades in wt-%

| Substrate | | | | | | | | | |
|---|---|---|---|---|---|---|---|---|---|
| Grade | Co | Cr | Ta | Nb | Ti | W | C | N | Hardness HV(3 kg) |
| A | 9.4 | — | — | 8.8 | 48.2 | 18.1 | 9.1 | 6.4 | 1800 |
| B | 12.9 | — | 18.3 | — | 40.1 | 15.5 | 7.7 | 5.5 | 1730 |
| C | 5.2 | 0.2 | — | — | — | 88.7 | 5.9 | — | 1775 |
| D | 17.9 | — | — | 9.9 | 42.2 | 16.2 | 5.7 | 8.1 | 1575 |

TABLE 2

Composition and thickness of the layers.

| Coating No. | CVD-layer* Ti(C, N)** μm | CVD α-$Al_2O_3$ μm | CVD Ti(C, N)** μm | CVD α-$Al_2O_3$ μm | Total thickness*** μm |
|---|---|---|---|---|---|
| 1 | 7.5 | 11.1 | 7.6 | 9.0 | 35.2 |
| 2 | 24.0 | 6.0 | — | — | 30.0 |
| 3 | 10.0 | 20.4 | — | — | 30.4 |
| 4 | 40.5 | 6.1 | — | — | 46.6 |
| 5 | 8.0 | 7.0 | — | — | 15.0 |

*CVD layer, closest to the substrate;
**Ti(C, N) layers thicknesses includes also thickness of bonding and transition layers, TiN, TiCO;
***total coating thickness including Ti(C, N) and $Al_2O_3$ layers, bonding layers, transition layers and top layers.

Example 2

Inserts of style CNMA120416 T02020, have a rake face land with a width of 200 μm with an angle of 20° to the rake face, with an edge honing of 30 μm (as measured on the uncoated insert) with substrates A, B, C, D with coatings 1, 2, 3, 4, 5 designated A/1, A/2, A/3, A/4, A5, B5, C/2, C/3, D5 were subjected to a cutting test, an external turning operation comprising packages of 4 discs of a nodular cast iron (NCI), comprising cast skin. The discs had a diameter of 250 mm and they were machined down to a diameter of 120 mm by repeated passes. The flank wear width of the cutting edge after machining 32 discs packages was measured. As a reference was also used commercially available $Si_3N_4$ ceramic insert with the same geometry.

Machining data:

| | |
|---|---|
| Workpiece: | SS0727, nodular cast iron (NCI) |
| Type of operation: | external turning operation |
| Cutting speed: | 600 m/min |
| Depth of cut: | 3 mm |
| Feed: | 0.35 mm/rev |
| Coolant: | dry operation |

RESULTS:

| Insert | Discs Packages No. | Wear (Vb-mm) | Comment |
|---|---|---|---|
| A/1 (invention) | 32 | 0.27 | even wear |
| A/2 (invention) | 32 | 0.30 | even wear |
| A/3 (invention) | 32 | 0.37 | even wear |
| A/4 (invention) | 32 | 0.23 | even wear |
| A/5 (invention) | 32 | 0.43 | even wear |
| B/5 (invention) | 32 | 0.46 | even wear |
| C/2 (prior art) | 32 | 0.66 | uneven wear |
| C/3 (prior art) | 17 | 0.55 | chipping |
| D/5 (comparative) | 12 | 0.75 | plast. deform. |
| $Si_3N_4$ ceramic (prior art) | 20 | 0.82 | uneven wear |

Example 3

Example 3 was performed with inserts A/3, A/4, C/3, D5 being produced in the same way as that in Example 2. The insert geometry was CNMA120416-KR, having a flat rake face, with an edge honing of 40 μm (as measured on the uncoated insert). The cutting tests including external turning operation in grey cast iron comprising packages of 4 discs with diameter of 250 mm, which were machined down to a diameter of 120 mm by repeated passes. The flank wear width of the cutting edge after machining 32 discs packages was measured. As a reference was also used commercially available $Si_3N_4$ ceramic insert with the same geometry.

Cutting data:

| | |
|---|---|
| Workpiece: | SS0125, grey cast iron (GCI) |
| Type of operation: | external turning operation |
| Cutting speed: | 850 m/min |
| Depth of cut: | 3 mm |
| Feed: | 0.35 mm/rev |
| Coolant: | dry operation |

RESULTS:

| Insert | Discs Packages No. | Wear (Vb-mm) | Comment |
|---|---|---|---|
| A/3 (invention) | 32 | 0.40 | even wear |
| A/4 (invention) | 32 | 0.26 | even wear |
| C/3 (prior art) | 25 | 0.61 | uneven wear |
| D/5 (comparative) | 8 | 0.80 | plast. deform. |
| $Si_3N_4$ ceramic (prior art) | 32 | 0.23 | even wear |

Example 4

Example 4 was performed with inserts A/2, A/3, A/4, C/3, B5, D5, being produced in the same way and having the same geometry as that in Example 2. The cutting tests including external turning operation in compact graphite iron (CGI) comprising packages of 4 discs with diameter of 250 mm, which were machined down to a diameter of 120 mm by repeated passes. The flank wear width of the cutting edge after machining 32 disc packages was measured.

Cutting data:

| | |
|---|---|
| Workpiece: | Compact graphite iron (CGI) |
| Type of operation: | external turning operation |
| Cutting speed: | 700 m/min |
| Depth of cut: | 3 mm. |
| Feed: | 0.35 mm/rev |
| Coolant: | dry operation |

RESULTS:

| Insert | Discs Package No. | Wear (Vb-mm) | Comment |
|---|---|---|---|
| A/2 (invention) | 32 | 0.32 | even wear |
| A/3 (invention) | 32 | 0.39 | even wear |
| A/4 (invention) | 32 | 0.29 | even wear |
| B/5 (invention) | 32 | 0.48 | even wear |
| C/3 (prior art) | 23 | 0.60 | uneven wear |
| D/5 (comparative) | 10 | 0.70 | plast. deform. |

Example 5

Inserts of style CNMA160616 T02520, having a rake face land with a width of 250 μm with an angle of 20° to the rake face and an edge honing of 30 μm (as measured on the uncoated insert), with substrates A, B, C, D with coatings 1, 2, 3, 4, 5 designated A/2, A/3, A/4, A5, B5, C/2, D5 were subjected to a cutting test, an external turning operation comprising package of 4 discs of a nodular cast iron (NCI), comprising cast skin. The discs had a diameter of 250 mm and they were machined down to a diameter of 120 mm by repeated passes. The flank wear width of the cutting edge after machining 48 discs packages was measured. As a reference was also used commercially available $Si_3N_4$ ceramic insert with the same geometry.

| Machining data: | |
|---|---|
| Workpiece: | SS0727, nodular cast iron (NCI). |
| Type of operation: | external turning operation. |
| Cutting speed: | 600 m/min |
| Depth of cut: | 6 mm. |
| Feed: | 0.40 mm/rev. |
| Coolant: | dry operation. |

RESULTS:

| Insert | Discs Packages No | Wear (Vb-mm) | Comment |
|---|---|---|---|
| A/2 (invention) | 48 | 0.32 | even wear |
| A/3 (invention) | 48 | 0.36 | even wear |
| A/4 (invention) | 48 | 0.26 | even wear |
| A/5 (invention) | 48 | 0.42 | even wear |
| B/5 (invention) | 48 | 0.45 | even wear |
| C/2 (prior art) | 48 | 0.66 | uneven wear |
| D/5 (comparative) | 22 | 0.80 | plast. deform. |
| $Si_3N_4$ ceramic (prior art) | 18 | 0.74 | uneven wear |

From Examples 2-5, it is evident that if the Co content in the cermet body is too high, as in (D/5), plastic deformation of the cutting edge will occur during cutting operation having negative influence on the tool performance.

The chipping observed in Example 2, insert C/3 (prior art), having a coating on a WC—Co based cemented carbide body is suspected to be related to CVD-cooling cracks present in coating. Such cracks can cause local crack related flaking of the coating resulting in early reactions between the work piece and the cemented carbide. No CVD-cooling cracks are present in coatings on cermet bodies.

From Examples 2-4 it is also evident that thicker CVD coatings on cermet bodies compared to thinner ones result in an increase of the cutting tool wear resistance.

It is surprising that, in spite of the known brittleness of cermets, thick CVD coatings can be used on cermet bodies with strong edge geometry and thus improve tool wear resistance at high productivity machining using large cutting depths without edge fracture.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cutting tool insert comprising:

a cermet body including a Co and/or Ni binder phase; and a coating deposited as a monolayer or as multiple and/or alternating layers of carbide, nitride or oxide deposited by CVD- and/or MTCVD-methods, wherein said cermet body includes more than 50 vol. % Ti-based carbonitride and less than 15 wt. % but more than 6 wt. % Co and/or Ni binder phase, wherein said cermet body has a hardness, measured as Vickers Hardness at 3 kg load (HV3), of >1650 HV3, and wherein said coating has:

(a) a thickness of 21-50 μm when the inserts have a flat rake face, without or with simple chipbreakers and a Co binder phase, or (b) a thickness of 10-50 μm when the inserts have a rake face land with a width of 100-300 μm with an angle of 10-25° to the rake face and a Co and/or Ni binder phase, and wherein at least one layer of the coating has a thickness of more than 6 μm, the at least one layer including at least one of carbide, nitride, carbonitride or carboxynitride of one or more of Ti, Zr and Hf or mixtures thereof, and the at least one layer is adjacent an alumina layer.

2. The cutting tool insert according to claim 1, wherein the grain size of the Ti-based carbonitride phase is 0.5-4 μm.

3. The cutting tool insert according to claim 1, wherein the at least one layer includes of a carbide, carbonitride or carboxynitride of one or more of Ti, Zr and Hf or mixtures thereof.

4. The cutting tool insert according to claim 3, wherein the coating includes a top layer of TiN with a thickness of <2 μm.

5. The cutting tool insert according to claim 4, wherein the TiN is an outermost layer on the clearance faces and the alumina is an outermost layer on the rake face.

6. The cutting tool insert according to claim 1, wherein the first layer adjacent to the cermet body has a thickness of more than 6 μm but less than 45 μm and the alumina layer adjacent to the first layer has a thickness of more than 4 μm but less than 44 μm.

7. The cutting tool insert according to claim 6, wherein the thickness of the first layer is more than 10 μm.

8. The cutting tool insert according to claim 6, wherein the thickness of the alumina layer is more than 15 μm.

9. The cutting tool insert according to claim 6, wherein the first layer comprises Ti(C,N).

10. The cutting tool insert according to claim 3, wherein the coating comprises:

a first layer adjacent the cermet body, the first layer including a carbide, nitride, carbonitride or carboxynitride of Ti, or Zr or Hf with a thickness of 6-30 μm;

an α-alumina layer adjacent said first layer with a thickness of 5-50 μm;

a further layer adjacent the alumina layer, the further layer including a carbide, carbonitride or carboxynitride of one or more of the metals Ti, Zr and Hf or mixtures thereof with a thickness of 5-30 μm; and a further α-alumina layer adjacent said further layer with a thickness of 5-30 μm.

11. The cutting tool insert according to claim 10, wherein the coating includes a top layer of TiN with a thickness of <2 μm.

12. The cutting tool insert according to claim 11, wherein the TiN-layer is an outermost layer on the clearance faces and the alumina is an outermost layer on the rake face.

13. The cutting tool insert according to claim 1, wherein the hardness of said cermet body is >1750 HV3.

14. The cutting tool insert according to claim 13, wherein the hardness of said cermet body is >1775 HV3.

15. The cutting tool insert according to claim 1, wherein the thickness of the coating is 25-50 μm when the inserts have a flat rake face, without or with simple chipbreakers and a Co binder phase.

16. The cutting tool insert according to claim 15, wherein the thickness of the coating is 30-50 μm when the inserts have a flat rake face, without or with simple chipbreakers and a Co binder phase.

17. The cutting tool insert according to claim 16, wherein the thickness of the coating is 35-50 μm when the inserts have a flat rake face, without or with simple chipbreakers and a Co binder phase.

18. The cutting tool insert according to claim 1, wherein the thickness of the coating is 15-50 μm when the inserts have a rake face land with a width of 100-300 μm with an angle of 10-25° to the rake face and a Co and/or Ni binder phase.

19. The cutting tool insert according to claim 18, wherein the thickness of the coating is 21-50 μm when the inserts have a rake face land with a width of 100-300 μm with an angle of 10-25° to the rake face and a Co and/or Ni binder phase.

20. The cutting tool insert according to claim 19, wherein the thickness of the coating is 30-50 μm when the inserts have a rake face land with a width of 100-300 μm with an angle of 10-25° to the rake face and a Co and/or Ni binder phase.

21. The process of using a coated cutting tool insert, comprising machining cast iron workpieces at a cutting speed of >300 m/min at a cutting depth of 2-8 mm and a feed rate of 0.2-0.7 mm/rev with the coated cutting tool insert according to claim 1.

22. The process of using a coated cutting tool insert according to claim 21, wherein the cutting speed is 400-1000 m/min.

23. A method of machining a workpiece, comprising removing material from the workpiece with the cutting tool insert according to claim 1, wherein the cutting tool operates at a cutting speed of >300 m/min at a cutting depth of 2-8 mm and a feed rate of 0.2-0.7 mm/rev and wherein the workpiece is nodular cast iron (NCI), compact graphite iron (CGI) or grey cast iron (GCI).

24. The cutting tool insert according to claim 1, wherein the alumina layer is an α-alumina layer.

* * * * *